US011149398B2

(12) United States Patent
Boucher et al.

(10) Patent No.: US 11,149,398 B2
(45) Date of Patent: Oct. 19, 2021

(54) APPARATUS AND METHOD FOR DRIVING A PILE INTO THE GROUND BEFORE LIFTING AND STABILIZING THE FOUNDATION OF A BUILDING

(71) Applicant: Stabiliforce Technologies Inc., Rouyn-Noranda (CA)

(72) Inventors: Francis Boucher, Rouyn-Noranda (CA); Camil Boucher, Rouyn-Noranda (CA)

(73) Assignee: Stabiliforce Technologies Inc., Rouyn-Noranda (CA)

( * ) Notice: Subject to any disclaimer, the term of this patent is extended or adjusted under 35 U.S.C. 154(b) by 205 days.

(21) Appl. No.: 16/500,754

(22) PCT Filed: Apr. 5, 2018

(86) PCT No.: PCT/CA2018/050418
§ 371 (c)(1),
(2) Date: Oct. 3, 2019

(87) PCT Pub. No.: WO2018/184110
PCT Pub. Date: Oct. 11, 2018

(65) Prior Publication Data

US 2020/0087882 A1 Mar. 19, 2020

(30) Foreign Application Priority Data

Apr. 5, 2017 (CA) ..... CA 2963531

(51) Int. Cl.
*E02D 27/48* (2006.01)
*E04G 23/06* (2006.01)
(Continued)

(52) U.S. Cl.
CPC ..... *E02D 7/16* (2013.01); *E02D 5/54* (2013.01); *E02D 37/00* (2013.01)

(58) Field of Classification Search
CPC .. E02D 7/16; E02D 5/54; E02D 37/00; E02D 27/48; E02D 35/005; E04G 23/065
(Continued)

(56) References Cited

U.S. PATENT DOCUMENTS 2,982,103 A * 5/1961 Revesz ..... E04G 23/04 405/230
3,179,374 A * 4/1965 Walli ..... E04B 1/3511 254/109
(Continued)

FOREIGN PATENT DOCUMENTS

CA 2031041 A1 5/1992

OTHER PUBLICATIONS

Extended European Search Report dated Nov. 20, 2020 for corresponding EP 18781355.5.
(Continued)

*Primary Examiner* — Edwin J Toledo-Duran
(74) *Attorney, Agent, or Firm* — Damien Calvet; Gowling WLG (Canada) LLP

(57) ABSTRACT

Described are an apparatus and method for driving piles prior to lifting and stabilizing foundations that have subsided in unstable ground. A press head, comprising two non-slip arms actuated by a safety lever, is connected to an angle cleat-type foundation piece secured to the foundation by a pair of hydraulic rams in order to drive the piles into the ground as far as the bedrock when the rams contract. The apparatus includes a safety system actuated by the lever for controlling the arms. In order to level the building, other hydraulic rams are installed on each driven pile, all connected in series in order that they may be actuated simultaneously in order to lift the building. When the foundations have been adequately raised and levelled, each pile and the
(Continued)

corresponding angle cleat-type foundation piece, both made of steel, are welded in order to stabilize the foundations.

20 Claims, 16 Drawing Sheets

(51) Int. Cl.
*E02D 35/00* (2006.01)
*E02D 7/16* (2006.01)
*E02D 5/54* (2006.01)
*E02D 37/00* (2006.01)

(58) Field of Classification Search
USPC ..... 405/230, 232
See application file for complete search history.

(56) References Cited

U.S. PATENT DOCUMENTS 3,789,559 A * 2/1974 Kirkes ..... E04B 1/0007 52/169.9
3,796,055 A * 3/1974 Mahony ..... E02D 27/48 405/230
3,902,326 A * 9/1975 Langenbach, Jr. ..... E02D 27/48 405/230
4,070,867 A * 1/1978 Cassidy ..... E02D 5/226 405/230
4,563,110 A * 1/1986 Langenbach, Jr. ..... E04G 23/0203 405/230
4,673,315 A * 6/1987 Shaw ..... E02D 35/00 405/229
4,678,373 A * 7/1987 Langenbach, Jr. ..... E02D 27/48 405/230
4,711,603 A * 12/1987 Rippe, Jr. ..... E01C 23/10 403/379.5
4,765,777 A * 8/1988 Gregory ..... E02D 35/00 254/29 R
4,832,535 A * 5/1989 Crambes ..... E02D 3/12 405/266
4,911,580 A * 3/1990 Gregory ..... E02D 35/00 254/29 R
4,925,345 A * 5/1990 McCown, Jr. ..... E02D 35/00 405/230
4,997,314 A * 3/1991 Hartman ..... E02D 7/20 405/233
5,006,015 A * 4/1991 Stephens ..... E02D 7/20 254/29 R
5,013,190 A * 5/1991 Green ..... E02D 35/00 254/29 R
5,018,905 A * 5/1991 Kinder ..... E02D 27/48 405/230
5,120,163 A * 6/1992 Holdeman ..... E02D 27/48 405/229
5,135,335 A * 8/1992 Stephens ..... E02D 7/20 405/229
5,139,368 A * 8/1992 Hamilton ..... E02D 27/48 405/229
5,154,539 A * 10/1992 McCown, Sr. ..... E02D 27/48 405/230
5,171,107 A * 12/1992 Hamilton ..... E02D 27/48 405/229
5,176,472 A * 1/1993 Kinder ..... E02D 27/48 405/230
5,205,673 A * 4/1993 Bolin ..... E02D 35/00 405/230
5,213,448 A * 5/1993 Seider ..... E02D 27/48 405/229
5,217,325 A * 6/1993 Freeman, III ..... E02D 27/48 405/229
5,234,287 A * 8/1993 Rippe, Jr. ..... E02D 27/48 405/230
5,246,311 A * 9/1993 West ..... E02D 35/00 405/229
5,269,630 A * 12/1993 Bolin ..... E02D 35/00 405/230
5,482,407 A * 1/1996 Raaf ..... E02D 5/00 405/229
5,492,437 A * 2/1996 Ortiz ..... E02D 35/00 254/29 R
5,722,798 A * 3/1998 Gregory ..... B66F 1/025 254/133 R
5,724,781 A * 3/1998 Matthias ..... E02D 35/00 52/125.1
5,800,094 A * 9/1998 Jones ..... E02D 35/00 254/133 R
5,951,206 A * 9/1999 Gregory ..... E02D 35/00 405/230
6,058,663 A * 5/2000 MacKarvich ..... E02D 27/02 52/167.3
6,079,905 A * 6/2000 Ruiz ..... E02D 27/48 405/229
6,142,710 A * 11/2000 Holland, Jr. ..... E02D 33/00 405/229
6,193,442 B1 * 2/2001 May ..... E02D 35/00 405/232
6,200,070 B1 * 3/2001 Knight ..... E02D 27/48 405/229
6,352,390 B1 * 3/2002 Jones ..... E02D 27/48 405/230
6,468,002 B1 * 10/2002 Gregory ..... E02D 27/48 254/29 R
6,503,024 B2 * 1/2003 Rupiper ..... E02D 27/48 405/229
6,539,685 B2 * 4/2003 Bell ..... E02D 35/00 405/229
6,659,692 B1 * 12/2003 May ..... E02D 35/00 405/230
6,814,524 B1 * 11/2004 Peterson ..... E02D 35/00 405/229
6,840,714 B1 * 1/2005 Vache ..... E02D 27/48 405/230
7,044,686 B2 * 5/2006 May ..... E02D 35/00 405/230
7,094,003 B2 * 8/2006 Faires ..... E02D 27/48 405/230
7,165,915 B2 * 1/2007 Queen ..... E02D 27/48 405/232
7,195,426 B2 * 3/2007 May ..... E02D 5/56 405/229
7,278,802 B2 * 10/2007 Bisson ..... E02D 27/48 405/230
7,402,002 B2 * 7/2008 Zidar ..... E02D 35/00 405/230
7,470,090 B2 * 12/2008 Heppner ..... E02D 5/56 248/219.3
7,744,316 B2 * 6/2010 Kaufman ..... E02D 35/005 405/230
7,780,376 B2 * 8/2010 Bracken ..... E04G 23/06 405/230
8,480,335 B1 * 7/2013 Hunter ..... E02D 5/00 405/230
8,540,461 B2 * 9/2013 Ong ..... E02D 11/00 405/230
8,887,451 B2 * 11/2014 Gregory ..... E04G 23/065 52/126.6
9,279,227 B2 * 3/2016 West ..... E02D 5/54
2002/0062622 A1 * 5/2002 Bell ..... E02D 35/00 52/741.15
2005/0220544 A1 * 10/2005 Bisson ..... E02D 35/00 405/230
2005/0238442 A1 * 10/2005 Queen ..... E04G 23/06 405/230
2006/0216117 A1 * 9/2006 Peterson ..... E02D 35/00 405/230
2007/0065232 A1 * 3/2007 Fanes ..... E02D 35/00 405/230

(56) References Cited

U.S. PATENT DOCUMENTS

| | | | | |
|---|---|---|---|---|
| 2007/0092340 | A1* | 4/2007 | Zidar | E02D 35/00 405/230 |
| 2009/0003938 | A1* | 1/2009 | Nishimori | E02D 5/80 405/232 |
| 2011/0222968 | A1* | 9/2011 | Ong | E02D 11/00 405/232 |
| 2012/0014754 | A1* | 1/2012 | Ong | E02D 11/00 405/232 |
| 2016/0186403 | A1* | 6/2016 | Tomchesson | E02D 5/526 405/244 |
| 2016/0333540 | A1* | 11/2016 | Kaufman | E04G 23/065 |
| 2020/0270827 | A1* | 8/2020 | Newcomb | E02D 35/005 |

OTHER PUBLICATIONS

International Search Report for PCT/CA2018/050418 (English version).

* cited by examiner

APPARATUS AND METHOD FOR DRIVING A PILE INTO THE GROUND BEFORE LIFTING AND STABILIZING THE FOUNDATION OF A BUILDING

REFERENCE TO PARENT APPLICATIONS

This present patent application is a U.S. national phase entry from the PCT patent application PCT/CA2018/050418 entitled "APPARATUS AND METHOD FOR DRIVING A PILE INTO THE GROUND BEFORE LIFTING AND STABILIZING THE FOUNDATION OF A BUILDING", filed on Apr. 5, 2018, and the PCT patent application claims the priority of Canadian patent application no. 2,963,531, untitled "Building foundation lifting and stabilization device", filed on Apr. 5, 2017 in the Canadian Intellectual Property Office. The content of both the PCT application and Canadian patent application is incorporated into the present application in its entirety.

FIELD OF THE INVENTION

The present invention essentially relates to systems capable of lifting and stabilizing the foundation of a building, and in particular an apparatus and method for driving a pile into the ground securely, the pile, once driven into the ground, being used to lift and stabilize the building.

BACKGROUND OF THE INVENTION

Residential homes and low buildings are erected on foundations that may not be in direct contact with a stable and loadbearing underground layer, for example a rocky substratum. These foundations are generally concrete slabs or comprise a footing on which a foundation wall rests. The foundation is generally wider than the foundation wall in order to distribute the weight of the structure on a larger surface of the loadbearing earth. As a result, the stability of these structures depends on the stability of the ground beneath the foundation. With time, the stability of the underlying ground may change for many reasons, such as changes in the water table, compacting of the soil, movements of the soil or others. When the stability of the support changes, the foundation moves or stabilizes. Not only do the support foundations separate or move, but the upper parts of the structure also separate, which creates unsightly cracks and other undesirable traits. The weakening of the structures of the building is a common phenomenon that may be extremely destructive for the integrity of the structure, reducing the value of the property.

The current devices and methods for correcting the weakening of foundations consist of using hydraulic jacks jointly with pillars to lift the foundations. The pillars, also called piles or pickets, are driven into the ground using hydraulic mechanisms until the pile reaches the rocky substrate or until the resistance of the pile is equal to the compression weight of the structure. Once these pillars are fastened in a stable underground bed or in several stable underground beds, additional lifting using hydraulic jacks increases the level of the foundation. When the foundation is raised to the desired level, the piles are permanently fixed to the foundation. The hydraulic jacks are next removed. This method for correcting the level of a foundation generally requires excavating a hole that is adjacent or below the foundation to position and operate the lifting equipment.

Various support and stabilization methods for the foundations have been developed, some of them having more success than others. Certain safety problems remain, and there is always a need for an apparatus and method that guarantee a high safety level.

BRIEF DESCRIPTION OF THE INVENTION

This summary is provided to present a selection of concepts in simplified form that are described in more detail below in the detailed description. The present summary does not aim to identify the main features or essential features of the claimed subject matter, or to be used to help determine the scope of the claimed subject matter.

According to a first aspect, the invention consists of an apparatus for driving a pile into loose soil until reaching sufficiently hard soil to support the pile, said pile next being used to lift and stabilize a foundation of a building. The apparatus comprises a foundation board suitable for being fastened to the foundation and comprising a first pile guide suitable for receiving the pile in the vertical position; and a press head suitable for being installed at a given distance above the foundation board. The press head comprises a second pile guide suitable for receiving the pile, the first and second pile guides being aligned so as to allow the pile to slide through the pile guides; a rigid frame secured to the second pile guide and surrounding the second pile guide so as to slide along the pile; and two nonskid arms arranged in an opposite manner relative to the pile, each arm comprising a proximal end mounted at the rigid frame via a first pivot and a distal end projecting toward the pile and defining a nonskid surface once in contact with the pile. The apparatus further comprises a security system comprising a security lever connected to the rigid frame, the security system being configured to connect the distal end of each arm to the security lever, the security lever making it possible simultaneously to pivot the two arms between an open position where the nonskid surface of each arm is separated from the pile and a closed position where the nonskid surface is in contact with the pile such that the pile is retained by the two arms of the press head. The apparatus also comprises at least one extensible and retractable hydraulic jack connecting the foundation board to the rigid frame of the press head, each jack making it possible to apply a force on the press head and to drive the pile into the ground when the security system is activated and the nonskid arms are in the closed position.

According to one preferred embodiment, the apparatus comprises a pair of extensible and retractable hydraulic jacks connecting the foundation board to the rigid frame of the press head, the apparatus then defining a vertical plane of symmetry dividing the foundation board, the press head and the pair of hydraulic jacks longitudinally in two. Each first pivot can preferably be connected to the proximal end of the arm corresponding to a first termination of the corresponding hydraulic jack, a second termination of the jack being connected via a second pivot to the foundation board.

According to one preferred embodiment, the security lever can also comprise a third pivot connecting the lever to the rigid frame, a proximal end moving away from the third pivot along the plane of symmetry and forming a handle to actuate the lever, and a distal end adjacent to the third pivot. Preferably, the security system further comprises, for each arm, a horizontal bar with a length allowing one end of the bar to bear below the arm at its distal end, the other end of the bar forming a fourth pivot with a first end of a rod perpendicular to the bar, a second end of the rod belonging to the plane of symmetry and forming a fifth pivot with the second end of the rod of the opposite arm, and a connecting element, for example a spring, belonging to the plane of symmetry and connecting the fourth pivot of the rods with the distal end of the lever such that when the lever is lowered, its distal end rises, driving, via the connecting element, the second ends of the rods upward, which, in turn, move the horizontal bars supporting the arms toward the plane of symmetry until the nonskid surfaces come into contact with the pile.

According to one preferred embodiment, the press head also comprises a brace carried by the rigid frame above the lever between the pivot and the proximal end of the lever so as to be perpendicular to the lever, the brace making it possible to prevent the lever from moving upward.

According to one preferred embodiment, the distal end of each arm forms a stop for keeping the brace of the security system below the corresponding arm.

According to one preferred embodiment, the foundation board also comprises at least one vertical plate connected to the first pile guide and having a plurality of holes making it possible to bolt said at least one vertical plate to the foundation. Preferably, the foundation board is L-shaped comprising a wing connected, perpendicular to a longitudinal direction of the first pile guide, to said at least one vertical plate, the wing thus forming a surface marrying a lower surface of the foundation. The foundation board can further comprise at least one reinforcing ring to reinforce the first pile guide, each reinforcing ring having a section compatible with the section of the pile guide such that the pile guide is inserted into each reinforcing ring.

According to one preferred embodiment, the nonskid surface of the arm belongs to an interchangeable surface module driven into the distal end of the arm. Preferably, the interchangeable surface module comprises a resilient polymer material, for example rubber, forming the nonskid surface.

According to one preferred embodiment, the pile comprises a plurality of extender modules nesting in one another so as to extend the pile to reach soil that is hard enough to support the pile.

According to one preferred embodiment, the pile defines a square section, the first and second pile guides having a tubular shape with a square section marrying the square section of the pile. Preferably, the pile ends with a pyramid-shaped module for penetrating the soil.

According to a second aspect, the invention consists of a method for driving a pile into loose soil until reaching sufficiently hard soil to support the pile, said pile next being used to lift and stabilize a foundation of a building. The method comprises the following steps:

i. fixing a foundation board comprising a first pile guide suitable for receiving the pile;

ii. procuring a press head suitable for being installed at a given distance above the foundation board and comprising:

a second pile guide suitable for receiving the pile, the first and second pile guides being aligned so as to allow the pile to slide through the pile guides;

a rigid frame secured to the second pile guide so as to slide along the pile; and two nonskid arms arranged in an opposite manner relative to the pile, each arm comprising a proximal end mounted at the rigid frame so as to pivot, and a distal end projecting toward the pile and defining a nonskid surface once in contact with the pile; the press head supporting:

a security system comprising a security lever connected to the rigid frame, the security system being configured to connect the distal end of each arm to the security lever, the security lever making it possible to pivot each arm between an open position where the nonskid surface is separated from the pile and a closed position where the nonskid surface is in contact with the pile such that the pile is retained by the press head;

iii. connecting the foundation board to the rigid frame of the press head with at least one extensible and retractable hydraulic jack;

iv. sliding the pile in the second guide of the press head, then in the first guide of the foundation board until the pile reaches the loose soil;

v. if applicable, positioning each jack in a maximally extended position;

vi. actuating the security system so as to be in the closed position;

vii. simultaneously actuating each hydraulic jack so as to apply a force on the press head and thus driving the pile into the soil; and viii. if applicable, if the pile has not reached hard enough soil to support the pile: actuating the lever of the security system such that the arms of the press head are in the open position, the press head rising under the action of each jack to return to the maximally extended position; and ix. if applicable, repeating steps v) to viii) until the pile reaches hard enough soil to support the pile.

According to a third aspect, the invention consists of a method for lifting and stabilizing a foundation of a building, the method including steps i) to ix) of the method defined above for each of the piles necessary to lift and stabilize the foundation. The method for lifting and stabilizing the foundation further comprises the following steps:

x. if applicable, removing each jack and the press head having served to install a last of said piles;

xi. lifting the foundation and the building by exerting, simultaneously and in a controlled manner, on each pile, an inverse force on the corresponding foundation board until reaching a desired position for the foundation and the buildings; and xii. permanently welding each pile to the respective foundation board in order to stabilize the building.

According to one preferred embodiment, in which step xi) consists of installing a hydraulic system suitable for bearing on each foundation board, the hydraulic systems being connected to one another so as to lift the foundation along the piles.

According to a fourth aspect, the invention relates to a kit for driving piles along a foundation, the kit comprising:

a press head as defined here including the security system as defined here;

at least one foundation board as defined here;

at least one hydraulic jack suitable for connecting one of the foundation boards to the press head;

optionally, at least one pile or a plurality of pile modules nesting in one another to form a pile; and optionally, a user manual for the kit.

According to a fifth aspect, the invention relates to the press head as defined here including the security system as defined here.

According to a sixth aspect, the invention relates to a foundation board suitable for being fixed to a foundation of a building, the reinforcing board being as defined here.

Advantageously, the security system of the apparatus for driving piles is activated or deactivated by the operator owing to the security lever at the same time that the operator controls the hydraulic system for driving the pile into the loose soil, thus ensuring total control during the driving of the piles and well beyond today's security standards.

The features of the present invention that are considered to be novel and inventive will be described in greater detail in the claims presented hereinafter.

DESCRIPTION OF THE DRAWINGS

The advantages, aims and features of the present invention will be more easily observable in reference to the following detailed description, which will be done using the figures, in which.

DETAILED DESCRIPTION OF THE PREFERRED EMBODIMENT

A new apparatus and method will be described hereinafter Although the invention will be described using the example of one or several preferred embodiments, it is important to understand that these preferred embodiments are used in order to illustrate the invention and not to limit its scope.

Figure 1:
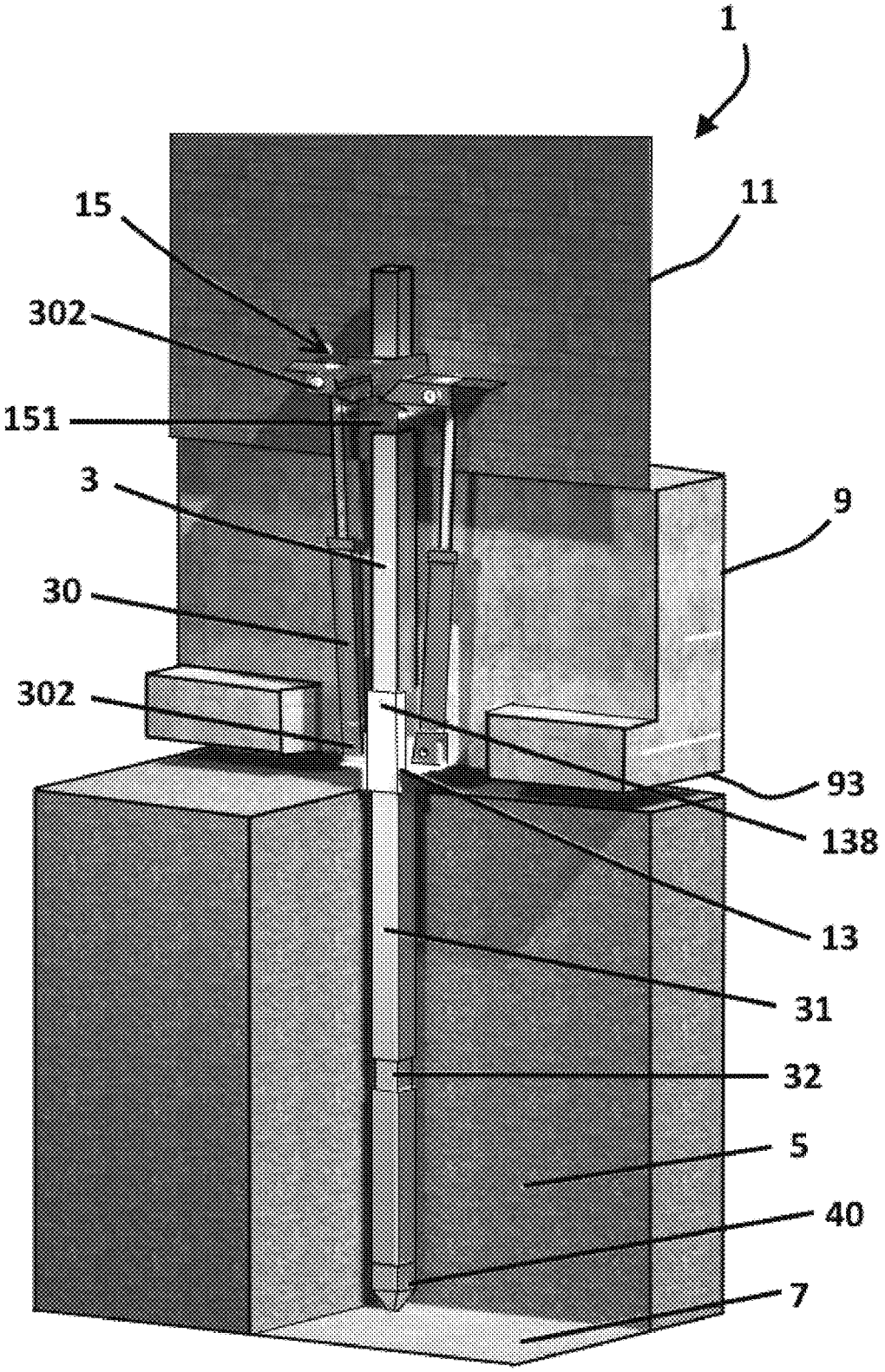
FIG. 1 illustrates an apparatus for driving piles installed along a foundation according to one preferred aspect of the invention.

As illustrated in FIG. 1, according to a first aspect, the invention consists of an apparatus (1) for driving a pile (3) into loose soil (5) until reaching hard enough soil (7) to support the pile, for example a rocky substrate or until the resistance of the pile is equal to the compression weight of the structure to be lifted. The pile (3), once driven to the soil (7), will be used in collaborate with other piles installed in the same manner to lift and stabilize a foundation (9) of a building (11) according to the method that will be described in more detail hereinafter.

As illustrated in FIG. 1, the foundation generally comprises a vertical outer wall (91) and a horizontal lower surface (93) or that is perpendicular to the outer wall. The foundations are generally made up of concrete slabs or comprise a footing (95) on which a foundation wall rests. The footing (95) is generally wider than the foundation wall (93) in order to distribute the weight of the structure on a larger surface of the loadbearing earth. Inasmuch as the present invention makes it possible in fine to lift the foundation of the building in order to stabilize the level or horizontality of the building, it must be understood that the terms "vertical" and "horizontal" are given as an indication of the direction of the described elements relative to one another, using the horizontality of the base of the foundation as coordinate system.

The pile (3) can be in one piece, but it is generally divided into several modules (31) that nest in one another so as to elongate the pile (3) as the latter is driven into the loose soil (5) so as to be able to reach the hard soil (7). The pile (3) generally ends with a penetration module (40) with a pointed shape in order to facilitate the penetration of the pile into the loose soil. The pile and penetration modules will be described in more detail hereinafter in reference to FIGS. 8 to 11.

Figure 2:
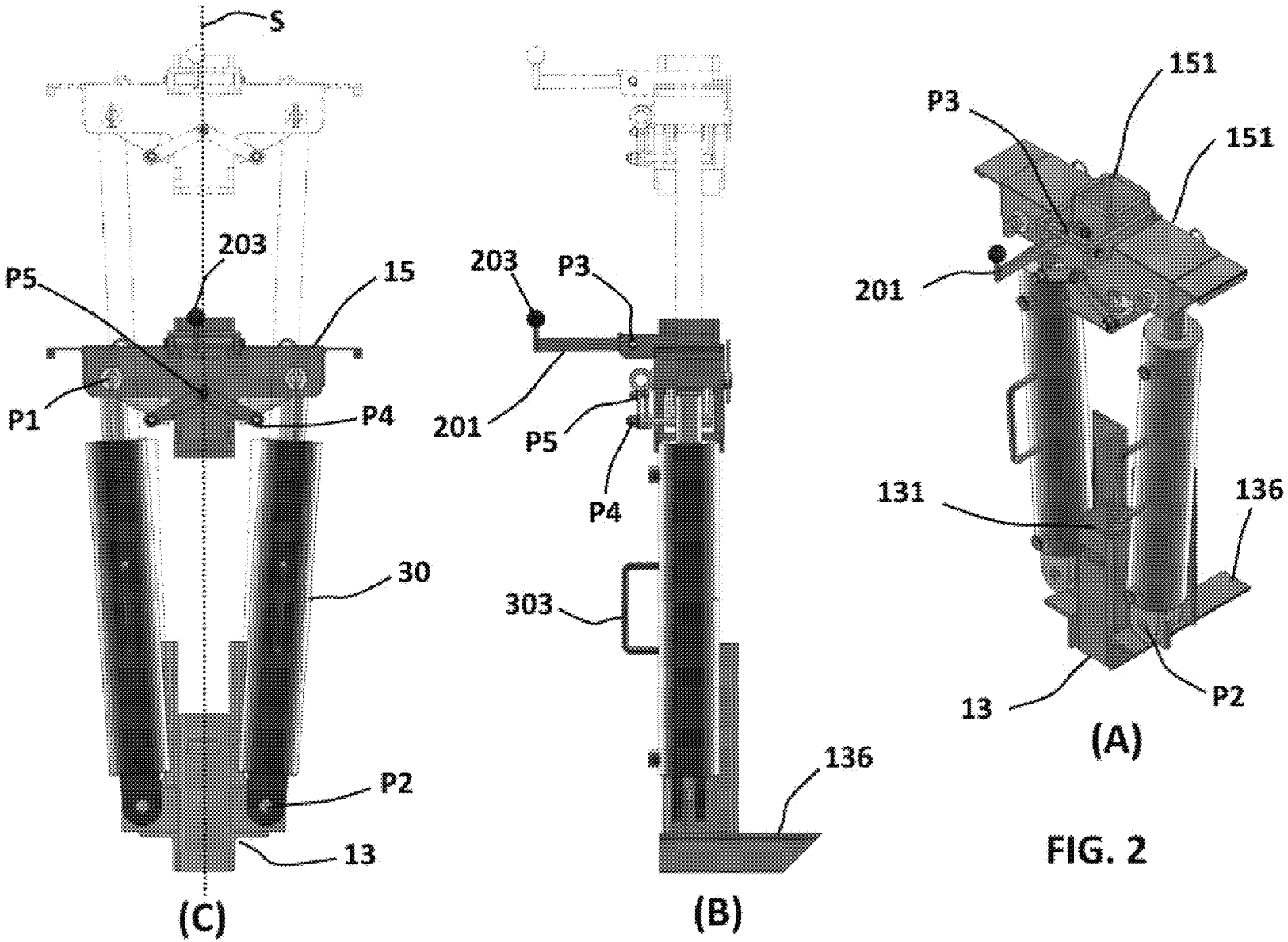
FIG. 2 illustrates an apparatus for driving piles according to one preferred aspect of the invention, in perspective (A), side (B) and front (C) view.

The pile driving apparatus (1) first comprises a foundation board (13) suitable for being fixed to the foundation (9), generally by bolting the board to the wall (91) of the foundation. The board is generally manufactured from plates and steel elements welded to one another. As outlined in FIGS. 2 and 7, the foundation board (13) comprises a first pile guide (131), generally vertical, suitable for receiving the pile (3) in the vertical position. The guide (131) can be a tubular element whose section is compatible with the section of the corresponding pile so as to be able to slide and guide the pile vertically. The pile shown here has a square section, and the section of the guide is therefore also square. It will be understood that other pile and guide section shapes can be considered without going beyond the scope of the protection imparted by the invention. For example, the piles and the pile guides can have can have [sic] a cylindrical shape.

Figure 7A:
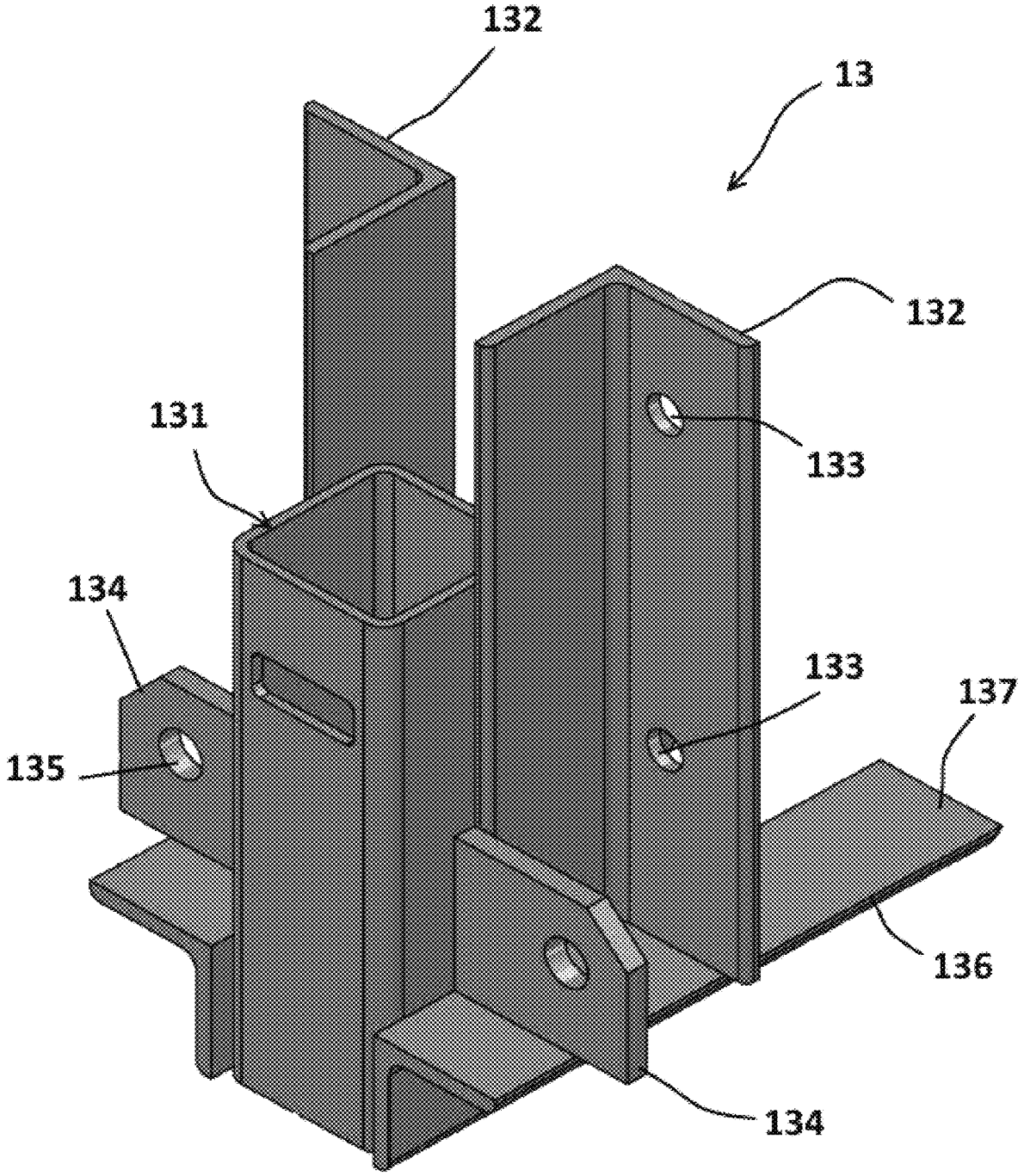
FIGS. 7A, 7B, 7C, 7D, 7E and 7F illustrate different foundation boards according to different aspects of the invention.
Figure 7B:
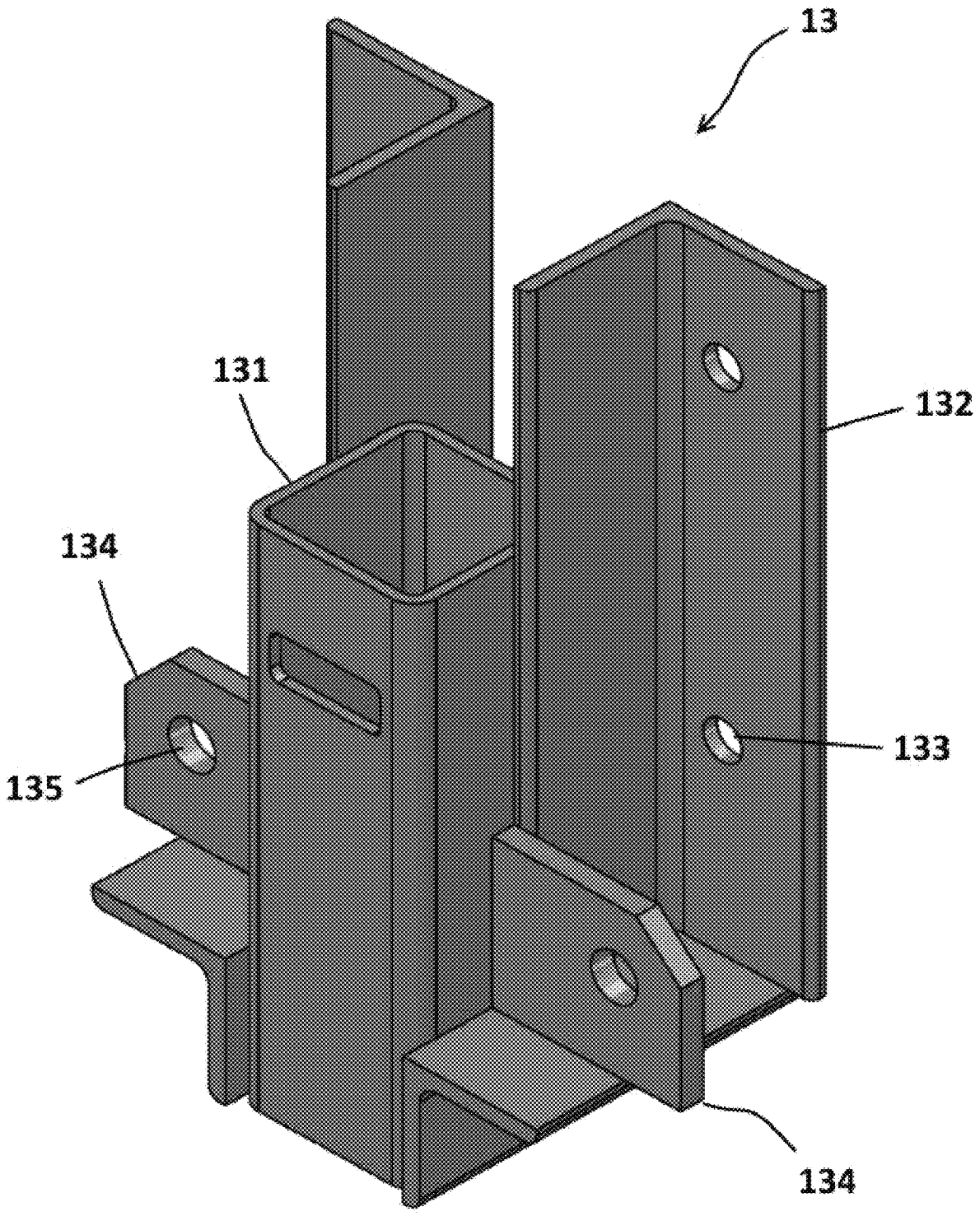
Figure 7C:
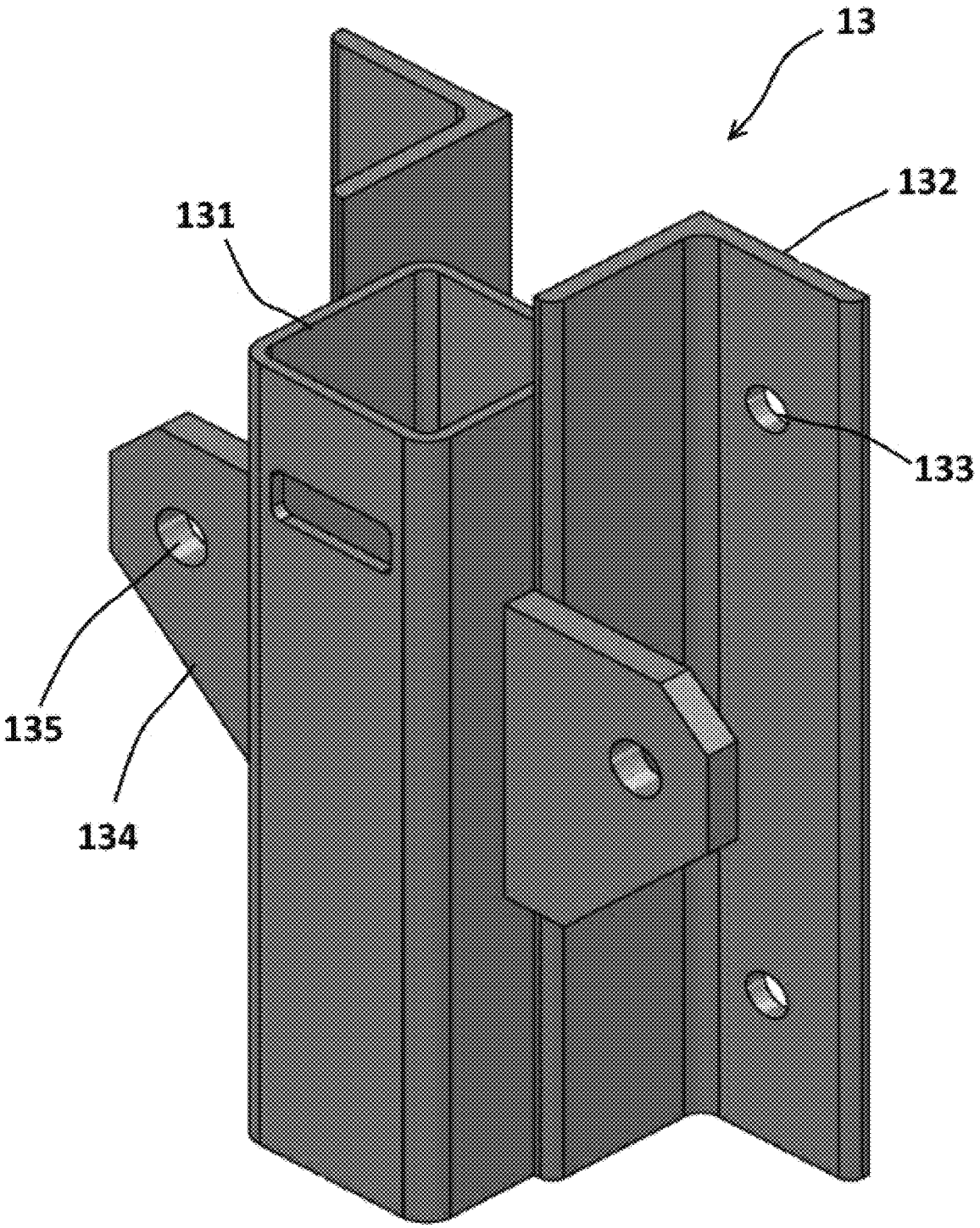
Figure 7D:
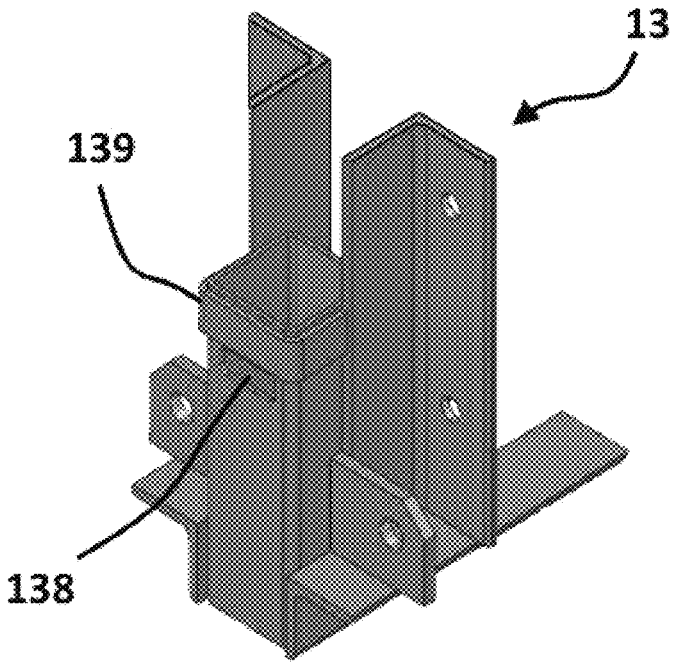

FIGS. 7A to 7F describe three options for foundation boards (13) that allow an installation of the board as a function of the shape or nature of the foundation and the base thereof. According to one preferred embodiment, the foundation board can also comprise a vertical plate (132), in general two plates welded on either side of the pile guide (131) and having a plurality of holes (133) making it possible to bolt the foundation board (13) to the foundation (9), in particular to the vertical wall (91) of the latter. The foundation board can further comprise fastening elements (134) provided with orifices (135) to fasten the hydraulic jack(s) to the board by pivoting. Preferably, as illustrated in FIG. 7A or 7D, the foundation board can be L-shaped comprising a wing (135) perpendicular to the longitudinal direction of the first pile guide (131), so as to form a surface (136) marrying the lower surface of the foundation (93). The wing (135) makes it possible to increase the support and the contact between the board and the foundation during the raising thereof. Furthermore, the reinforcing board can comprise a weld spot (138), generally an orifice positioned on the front surface of the first pile guide, so as to facilitate and/or allow the fixing of the pile to the reinforcing board by welding.

Figure 7E:
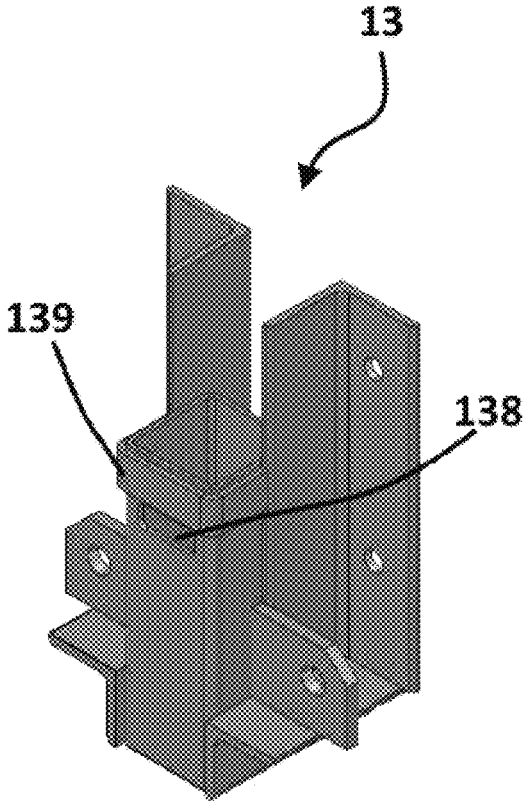
Figure 7F:
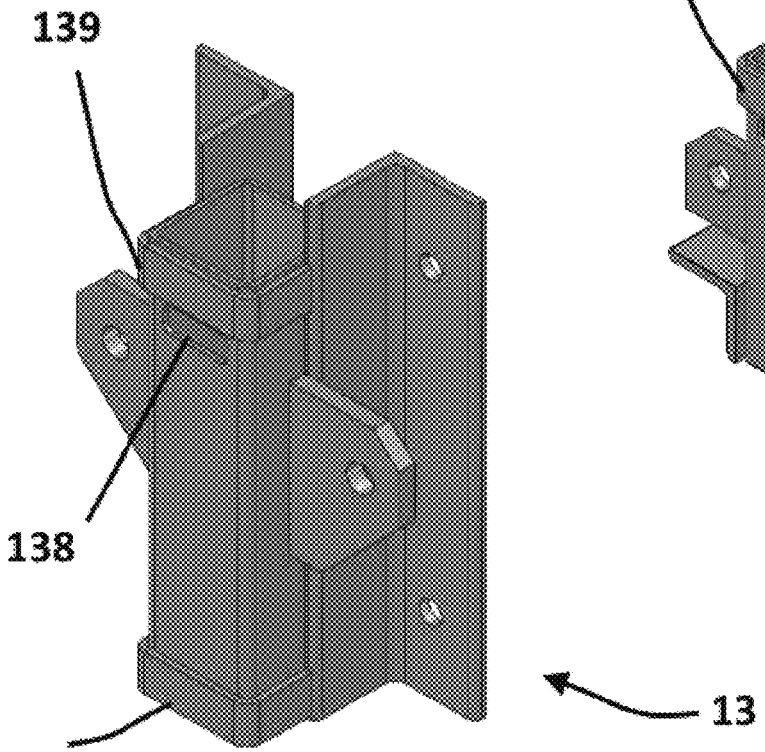
Figure 8:
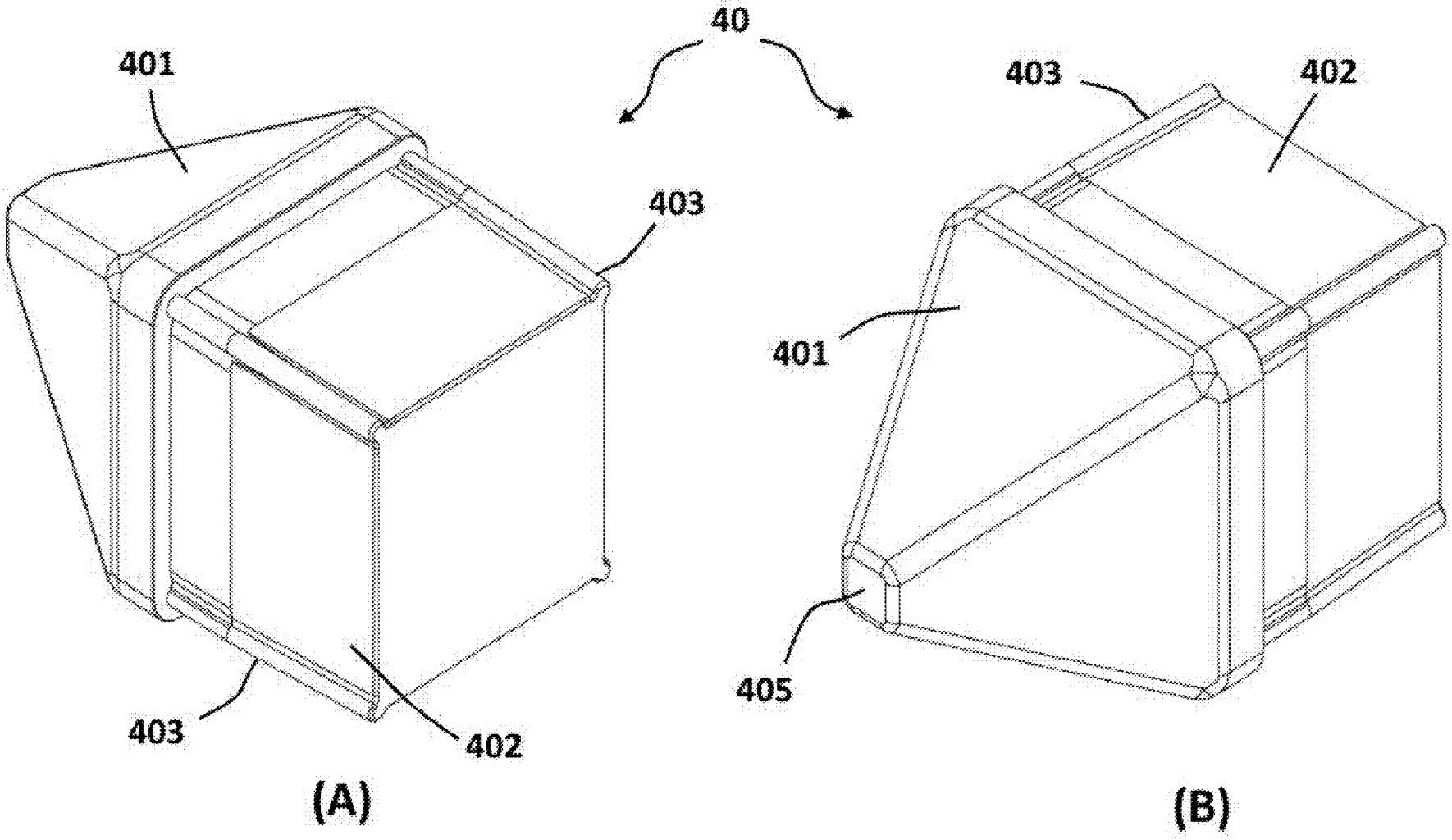
FIG. 8 illustrates a pyramid-shaped penetration module of the pile in rear perspective view (A) or in front perspective view (B) according to one preferred aspect of the invention.
Figure 9:
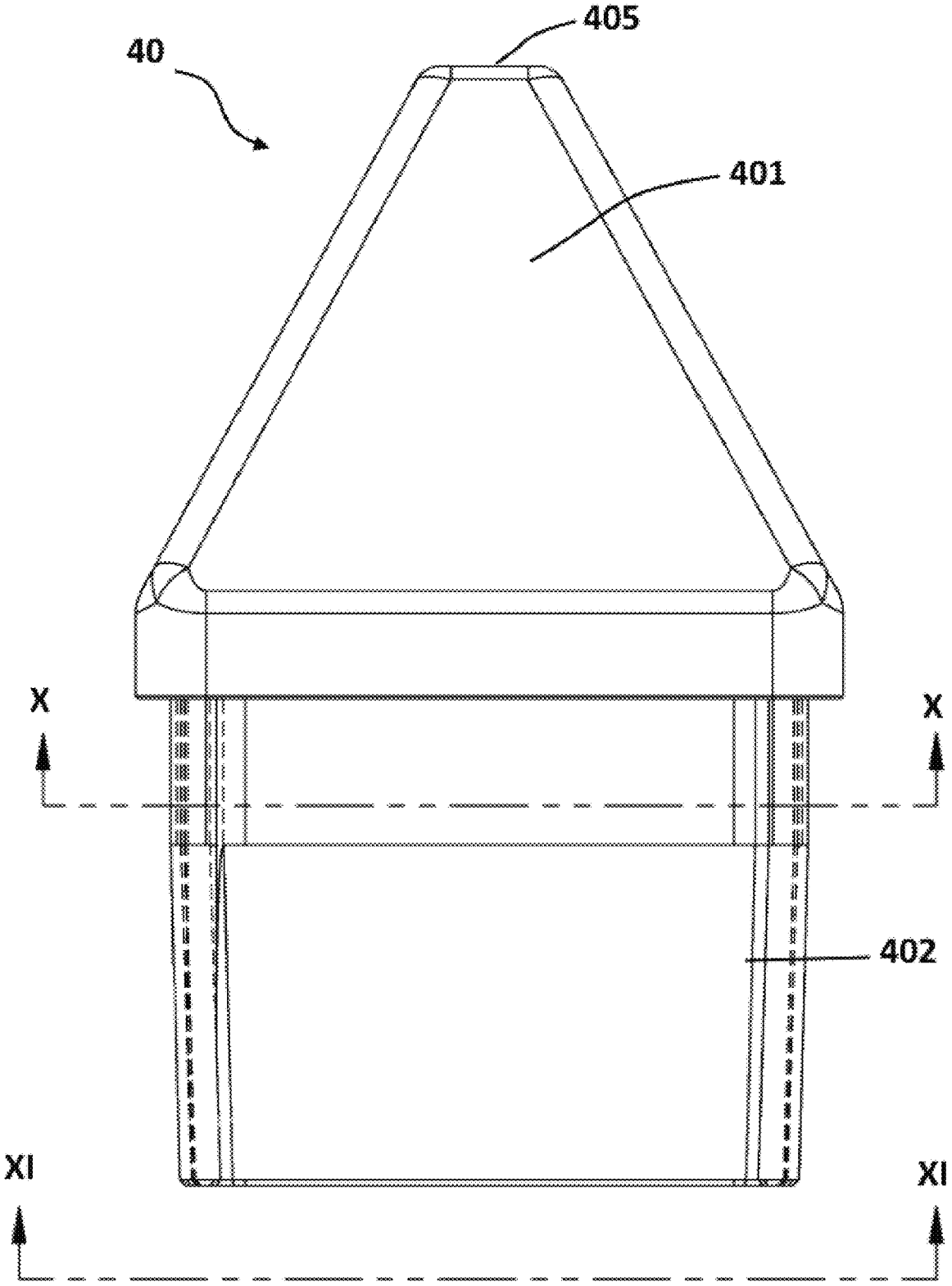
FIG. 9 illustrates the pyramid-shaped penetration module of the pile of FIG. 8 in side view.
Figures 10, 11:
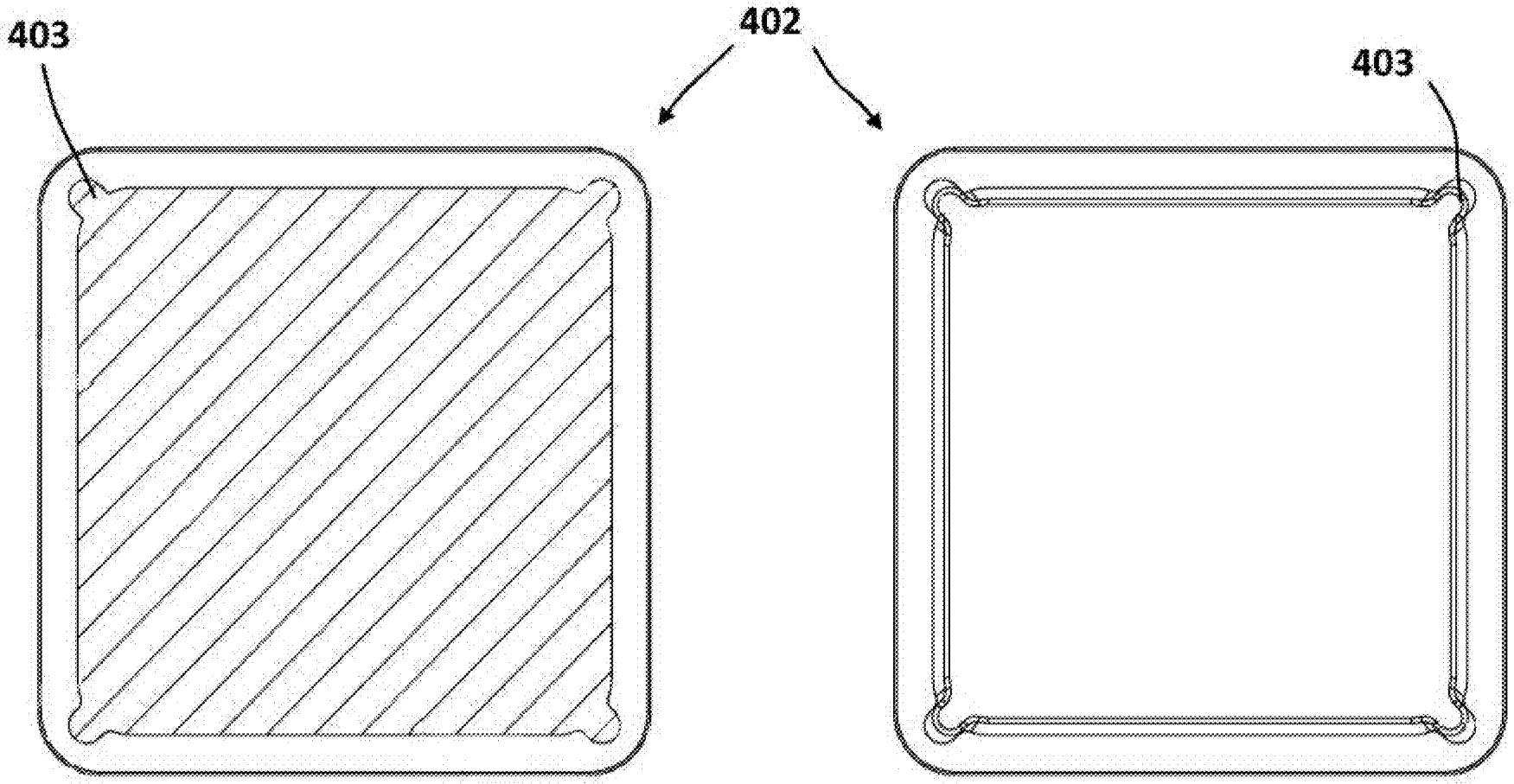
FIG. 10 is a sectional view along line X-X of FIG. 9.
FIG. 11 is a sectional view along line XI-XI of FIG. 9.

As illustrated in FIGS. 7D to 7E, the foundation board (13) can also comprise at least one reinforcing ring (139) to reinforce the first pile guide (131), each reinforcing ring having a section compatible with the section of the pile guide such that the pile guide is inserted into each reinforcing ring. If the first long guide is long, like in the example of FIG. 7E, two reinforcing rings (139) will be welded to the two opposite ends of the pile guide (131).

Figure 3A:
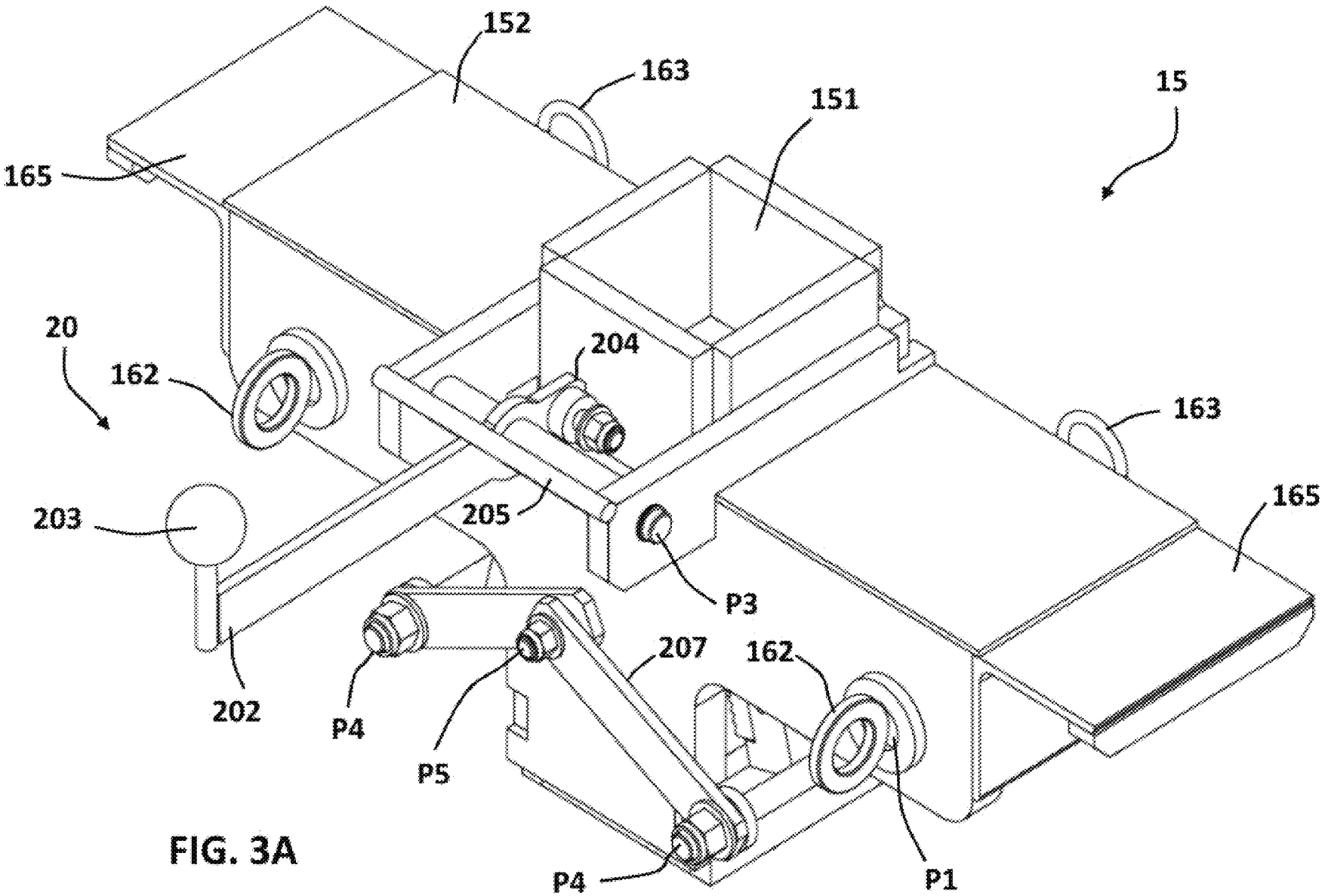
FIGS. 3A and 3B illustrate a press head including the security system according to one preferred aspect of the invention.
Figure 3B:
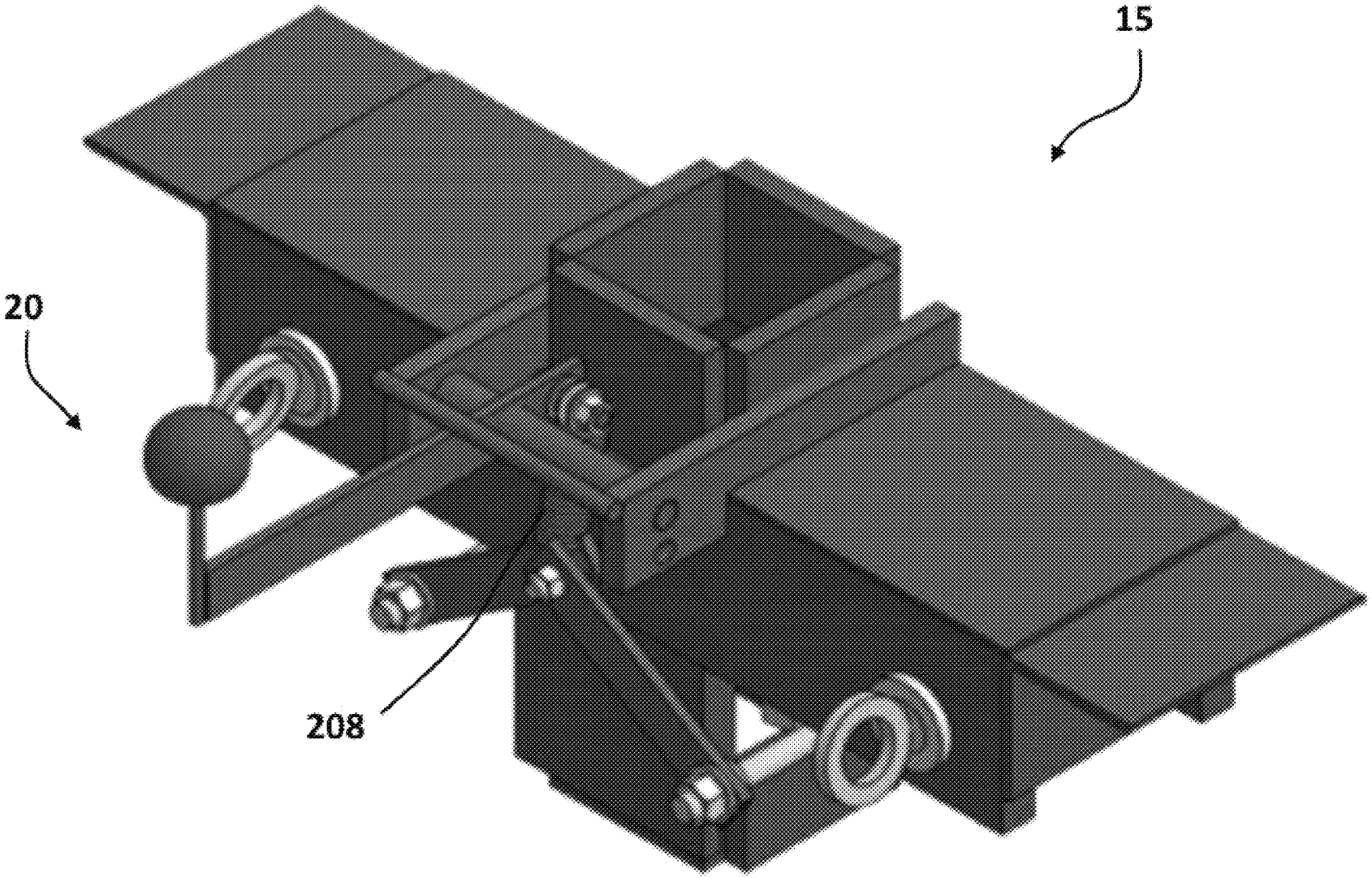
Figure 4:
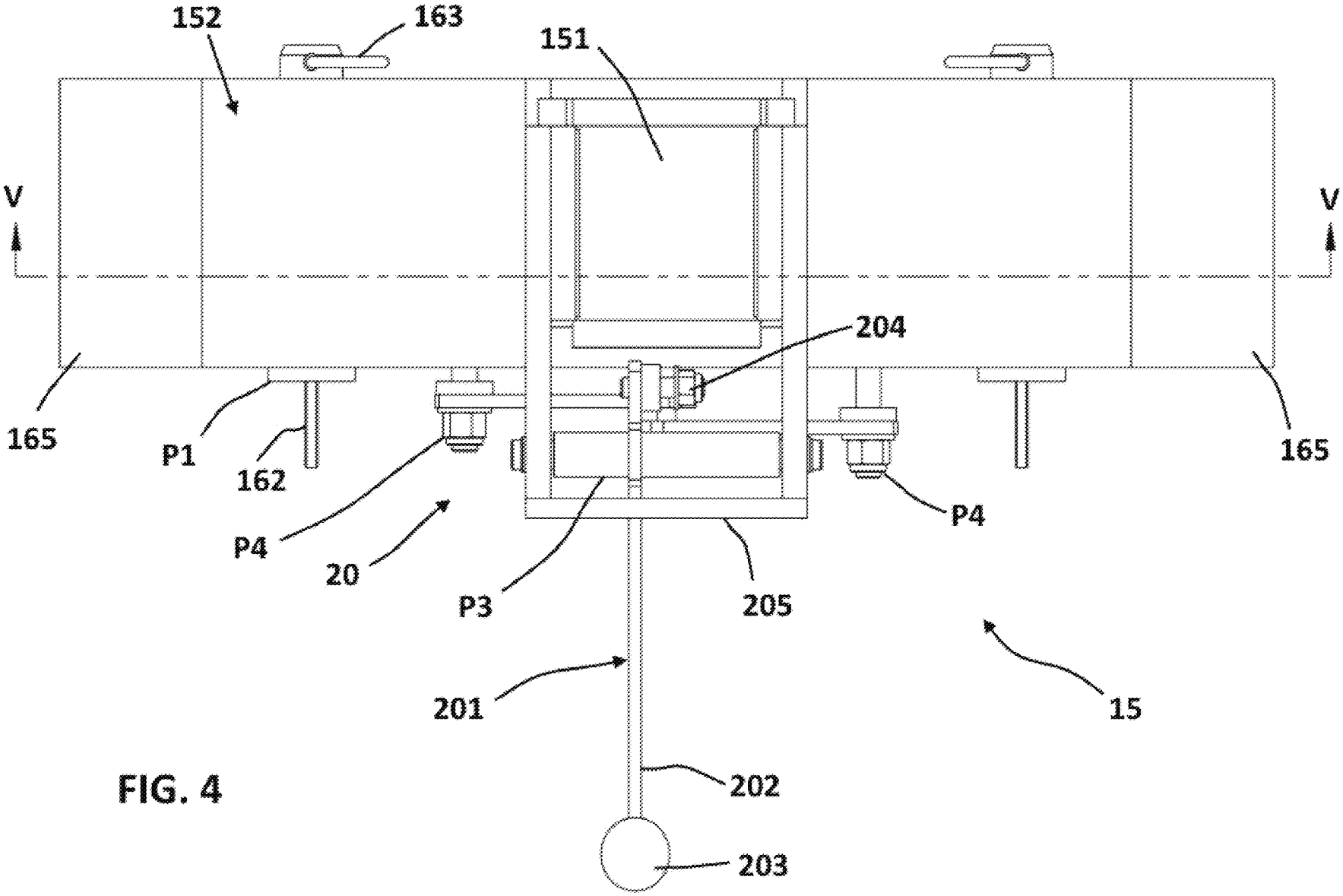
FIG. 4 illustrates a press head including the security system seen from above according to one preferred aspect of the invention.
Figure 5:
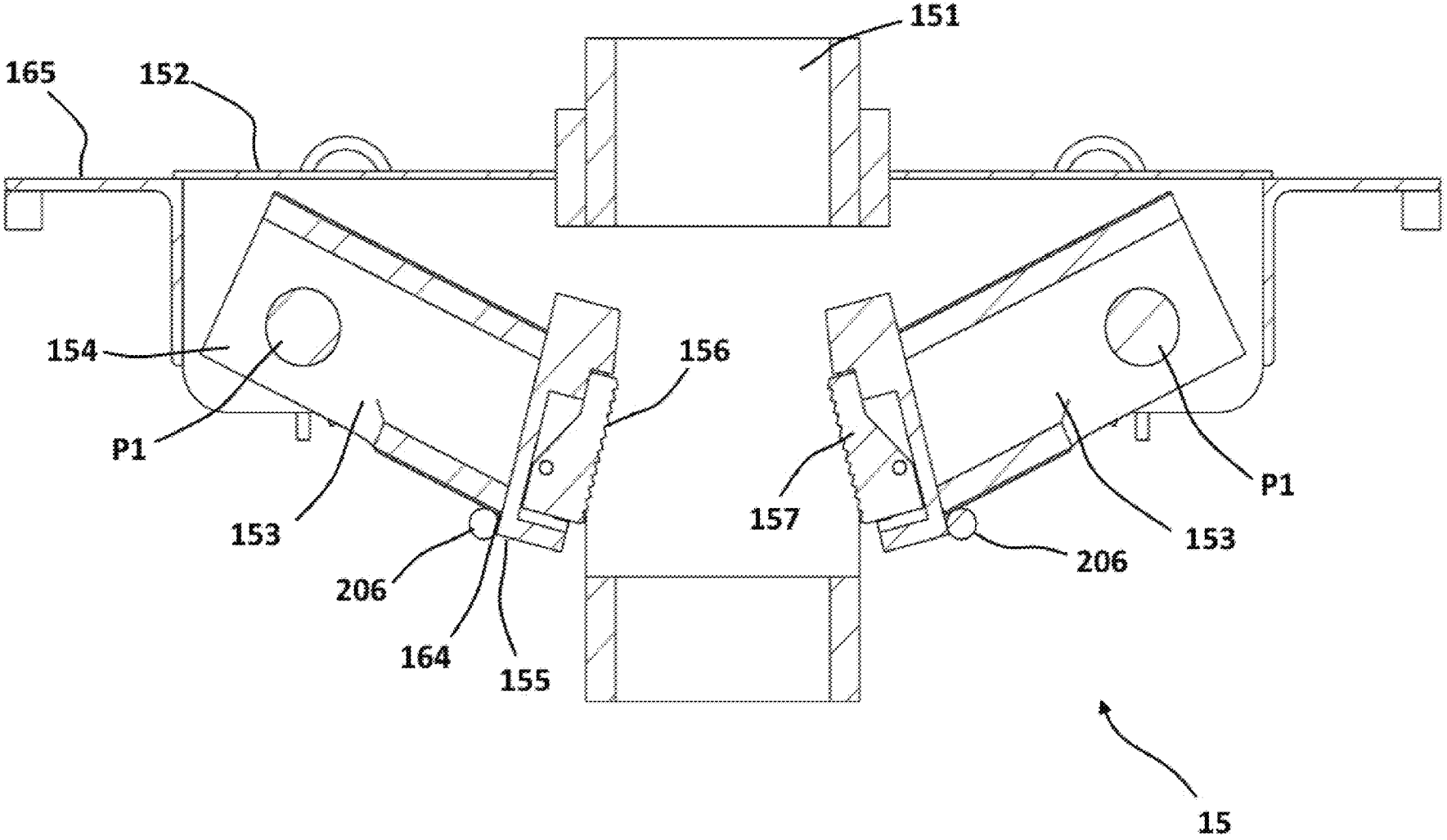
FIG. 5 is a sectional view of a press head along line V-V of FIG. 4.
Figure 6:
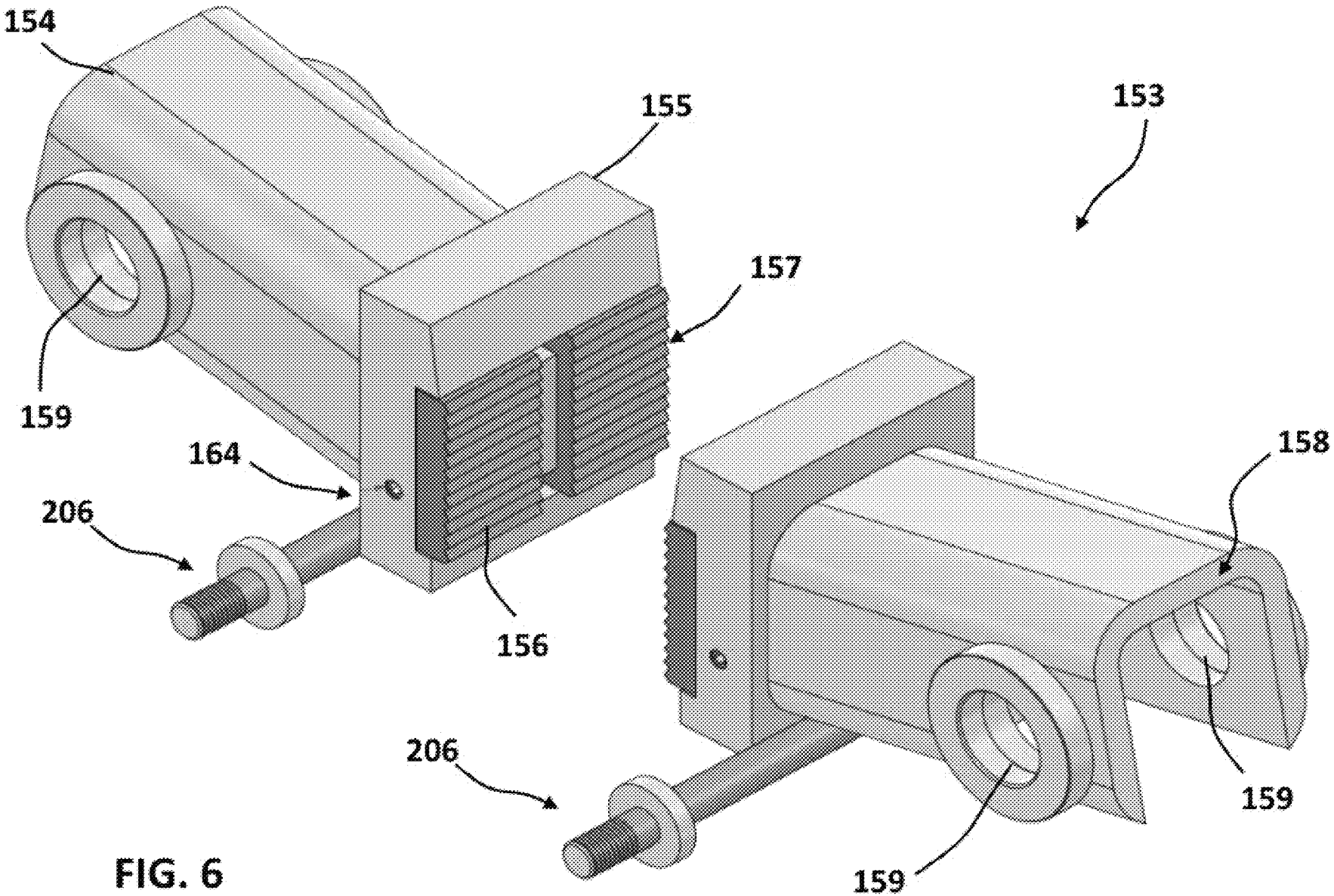
FIG. 6 illustrates the arms of the press head according to one preferred aspect of the invention.

As illustrated in FIG. 1, and in more detail in FIGS. 2 to 6, the apparatus also comprises a press head (15) suitable for being installed at a given distance above the foundation board (13). This distance is relative to the length of the jacks used. The press head (15) comprises a second pile guide (151) suitable for receiving the pile (3). The first and second pile guides (131, 151) are aligned so as to allow the pile to slide through the pile guides. The press head (15) also comprises a rigid frame (152) secured to the second pile guide (151) and surrounding the second pile guide so as to slide along the pile. Two nonskid arms (153) are arranged in an opposite manner relative to the pile. Each arm comprising a proximal end (154) mounted at the rigid frame via a first pivot (P1) and a distal end (155) projecting toward the pile and defining a nonskid surface (156) once in contact with the pile (3). As illustrated in FIGS. 5 and 6, the nonskid surface (156) can belong to an interchangeable surface module (157) driven into the distal end (155) of the arm (153). The module can be made from a resilient polymer material, for example of the rubber type, in order to promote the nonskid effect of the surface (156). The operator will be able to change the surface module (157) easily when the latter becomes too worn after use. The surface of the surface module will be able to be adapted to the exposed surface of the pile (3) in contact. A flat surface will be preferred for a pile with a square section as illustrated in the figures. A nonskid surface with a concave shape will be preferred for a pile with a tubular or circular section.

As illustrated in FIGS. 3 and 4, the opposite edges of the rigid frame (152) can form a pair of handles (165) making it possible to manipulate the press head (15) easily and securely during the assembly and disassembly of the apparatus (1).

The apparatus (1) further comprises a security system (20) comprises a security lever (201) that allows the operator to actuate the press head (15) securely during the driving of the pile. The security system (2) is connected to the rigid frame (152) and is configured to connect the distal end (155) of each arm (153) to the security lever (201). The security lever (201) makes it possible to simultaneously pivot both arms between an open or inactive position in which the nonskid surface (156) of each arm (153) is moved away from the pile and the latter can then slide through the pile guide (151), and a closed or active position in which the nonskid surface (156) of both arms is in contact with the pile such that the pile is retained by both arms of the press head forming a jaw.

The apparatus (1) also comprises at least one extensible and retractable hydraulic jack (30) connecting the foundation board (13) to the rigid frame (152) of the press head (15), each jack making it possible to apply a force on the press head and to drive the pile into the ground when the security system is activated and the nonskid arms are in the closed or active position. According to the preferred embodiment illustrated in the Figures, the apparatus (1) comprises a pair of extensible and retractable hydraulic jacks (30) connecting the foundation board to the rigid frame of the press head. The apparatus (1) then defines a vertical plane of symmetry (S in FIG. 2C) dividing the foundation board, the press head and the pair of hydraulic jacks longitudinally in two. For each hydraulic jack (30), a first termination of the jack (301) is connected to the press head at the proximal end of the corresponding arm (154) and the opposite termination of the jack (302) is connected via a second pivot (P2) to the foundation board. Each hydraulic jack (30) can comprise a handle (303) so as to manipulate each jack easily and securely during the assembly or disassembly of the apparatus (1).

As illustrated in particular in FIGS. 2 to 6, the first termination of the jack (301) is connected to the press head via the same first pivot (P1) as that used to maintain and pivot the corresponding arm of the press head. The proximal end (154) of each arm defines an inverted U (158) wide enough to accommodate the termination of the jack (30). The walls of the inverted U, which face one another, are each provided with an orifice (159), which are aligned. Two similar orifices (160) are present on the rigid frame (152). Lastly, the termination (301) of the jack (30) is provided with an identical orifice. The pivot (P1) is then formed by a key (161), in tube form, configured to be inserted into all of the aligned orifices of the rigid frame (160), the orifices of the proximal end of the arm in inverted U form (159) and the termination (301) of the jack. The key (161) can be provided at one end with a retaining ring (162) and at the opposite end with a safety pin (163). The operator can then easily disassemble the apparatus by removing the safety pin, then removing the key using the retaining ring by pulling on the latter in order to eliminate the pivot (P1). The arms and the jacks are then separated from the rigid frame. Conversely, the key allows easy and quick reassembly of the apparatus when the latter must be moved to drive another pile.

The present invention has the advantage of including a security lever (201) that is easily maneuverable by the operator. According to one preferred embodiment illustrated in FIGS. 2 to 6, the security lever (201) is connected to the rigid frame (152) by a third pivot (P3). The proximal end (202) of the lever (201) moves away from the third pivot (P3) along the plane of symmetry and can comprise a handle (203) to actuate the lever. The distal end (204) of the lever (201) is adjacent to the third pivot (P3). The press head (15) comprises a brace (205) carried by the rigid frame (152) above the lever between the pivot (P3) and the proximal end (202) so as to be perpendicular to the lever in order to limit the upward movement of the latter, thus preventing damage to the security system (20). Indeed, during the driving of a pile and the downward movement of the press head under the effect of the jacks, the lever may become caught or retained, which would cause the opening of the arms before the jack has reached its maximally contracted position.

The security system (20) of the apparatus (1) also comprises, for each arm, a horizontal bar (206) with a length allowing one end of the bar to bear below the arm (153) at its distal end, the other end of the bar (206) forming a fourth pivot (P4) with a first end of a rod (207) perpendicular to the bar. The second end of the rod (207) belongs to the plane of symmetry (S) and forms a fifth pivot (P5) with the second end of the rod of the opposite arm (see FIG. 3A). The fifth pivot (P5) and the distal end (204) of the lever are connected by a connecting element, for example a spring (208) belonging to the plane of symmetry. When the lever is lowered, its distal end (204) rises, driving, via the connecting element, the second ends of the rods (207) upward, which, in turn, move the horizontal bars (206) supporting the arms (153) toward the plane of symmetry until the nonskid surfaces (156) come into contact with the pile (3).

According to one preferred embodiment and which is illustrated in FIGS. 5 and 6, the distal end of each arm (155) can form a stop (164) for keeping the horizontal bar (206) of the security system below the corresponding arm (153).

As shown in FIG. 1, the piles (3) that will be driven into the soil can comprise several extender modules (31) nesting in one another (32) so as to elongate the pile enough to reach hard enough soil to support the pile. In the Figures, the pile (3) defines a square section, the first and second pile guides having a tubular shape with a square section marrying the square section of the pile. Preferably, the pile ends with a module for penetrating the soil (40). The pyramid shape illustrated in FIGS. 1 and 8 to 11 promotes a straight penetration into the loose soil (5) The four-sided pyramid (401) comprises a base (402) suitable for forming a male section that nests in a first pile module (31) with a square section forming a compatible female section (not shown). The solidity of the base is reinforced, and the nesting and maintenance of the penetration module on the pile are promoted by the presence of tubings (403) forming the four corners of the base (402). The tubings are configured to nest in compatible gutters (not shown) of a female section of the pile. The extender modules of the piles can comprise a male section similar to the base of the penetration module and an opposite female section to accommodate the male section of the following module. As shown in FIGS. 8 to 11, the section of the base (402) can narrow moving away from the pyramid-shaped head in order to promote the nesting of the penetration module in the first pile module (31). Lastly, the tip of the pyramid (405) can have a flat surface reinforcing the solidity of the tip while ensuring better contact between the pile and the sufficiently hard soil (7) to support the pile (3).

Figure 12:
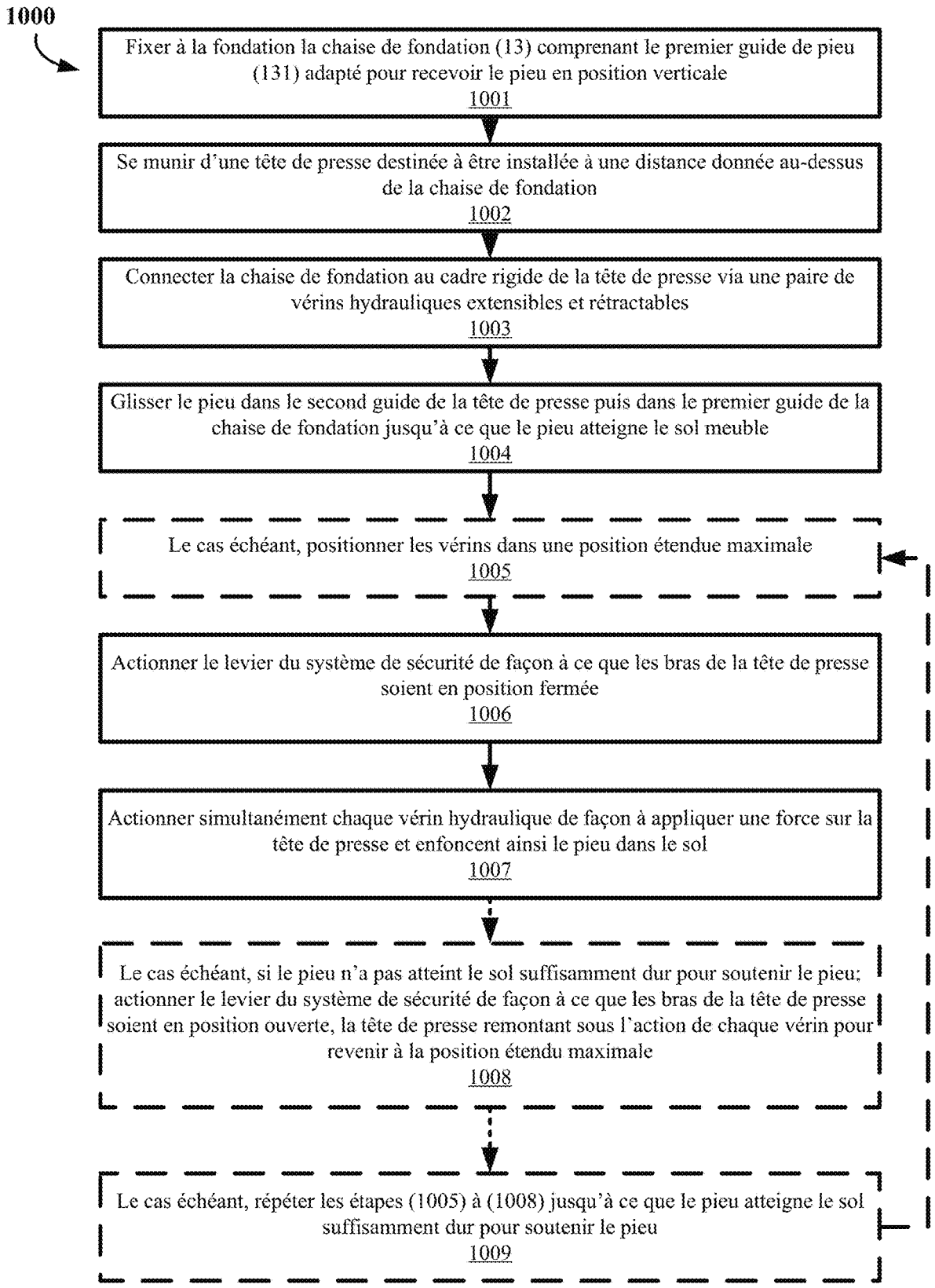
FIG. 12 is a flowchart illustrating the method for driving a pile into loose soil until reaching soil hard enough to support the pile according to one preferred aspect of the invention.
Figure 13:
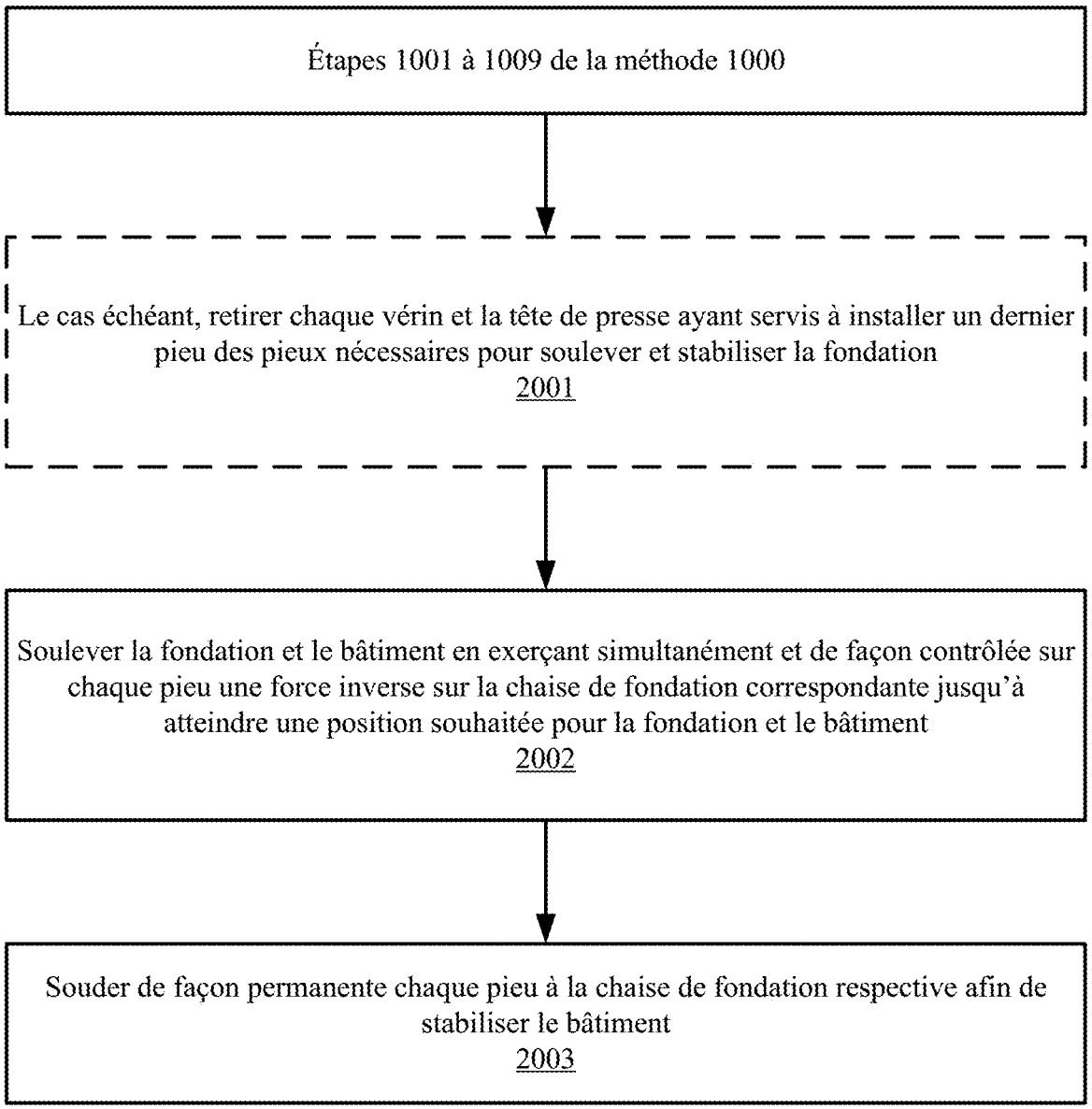
FIG. 13 is a flowchart illustrating the method for lifting and stabilizing a foundation of a building according to one preferred aspect of the invention.

According to a second aspect of the invention illustrated by the flowchart of FIG. 12, a method is described for driving a pile into loose soil until reaching soil hard enough to support the pile, for example rocky soil. The pile in collaboration with other piles driven in the same manner next serve to lift and stabilize the foundation of the building.

The method (1000) comprises the following steps:

i. fixing the foundation board to the foundation, for example by bolting the board to the concrete of the foundation, the board comprising a first pile guide suitable for receiving the pile (1001);

ii. procuring a press head suitable for being installed at a given distance above the foundation board (1002), the press head comprising:

a second pile guide suitable for receiving the pile, the first and second pile guides being aligned so as to allow the pile to slide through the pile guides;

a rigid frame secured to the second pile guide so as to slide along the pile; and two nonskid arms arranged in an opposite manner relative to the pile, each arm comprising a proximal end mounted at the rigid frame so as to pivot, and a distal end projecting toward the pile and defining a nonskid surface once in contact with the pile; and the press head supporting:

a security system comprising a security lever connected to the rigid frame, the security system being configured to connect the distal end of each arm to the security lever, the security lever making it possible to pivot each arm between an open position where the nonskid surface is separated from the pile and a closed position where the nonskid surface is in contact with the pile such that the pile is retained by the press head;

iii. connecting the foundation board to the rigid frame of the press head via at least one extensible and retractable hydraulic jack, preferably a pair of jacks (1003);

iv. sliding the pile in the second guide of the press head, then in the first guide of the foundation board until the pile reaches the loose soil (1004);

v. if applicable, positioning each jack in a maximally extended position (1005);

vi. actuating the lever of the security system so as to be in the closed position (1006);

vii. simultaneously actuating each hydraulic jack such that the latter apply a force on the press head and thus driving the pile into the soil (1007); and viii. if applicable, if the pile has not reached hard enough soil to support the pile: actuating the lever of the security system so as to be in the open position, thus making it possible to release the arms of the press head, the latter rising under the action of the jacks to return to the maximally extended position (1008); and ix. if applicable, repeating steps v) to viii) until the pile reaches hard enough soil to support the pile (1009).

According to a third aspect, the invention consists of a method for lifting and stabilizing a foundation of a building (2000). The method first comprises steps i) to ix) of the method defined above in order to drive, along the foundation, the piles necessary to lift and stabilize the foundation. The method for lifting and stabilizing the foundation further comprises the following steps:

x. if applicable, removing the pair of jacks and the press head having served to install a last pile of the piles necessary to lift and stabilize the foundation (2001);

xi. lifting the foundation and the building by exerting, simultaneously and in a controlled manner, on each pile, an inverse force on the corresponding foundation board until reaching a desired position for the foundation and the buildings (2002); and xii. permanently welding each pile to the respective foundation board in order to stabilize the building (2003).

According to one preferred embodiment, step xi) (2002) consists of installing a set of hydraulic systems, each system being suitable for bearing on one of the foundation boards installed in collaboration with the pile retained vertically by the first pile guide. The hydraulic systems are connected to one another so as to operate simultaneously and under the control of the operator so as to lift the foundation along the piles.

According to another aspect, the invention relates to a kit for driving piles along a foundation, the kit comprising:

a press head as defined hereinabove including the security system as defined here;

at least one foundation board as defined hereinabove;

at least one hydraulic jack, preferably a pair of hydraulic jacks, suitable for connecting one of the foundation boards to the press head;

optionally, at least one pile or a plurality of pile modules as defined here; and optionally, a user manual for the kit.

According to another aspect, the invention relates to the press head as defined here including the security system as defined here. The invention also relates to the foundation boards described here.

Advantageously, the security system of the apparatus for driving piles is activated or deactivated by the operator owing to the security lever at the same time that the operator controls the hydraulic system for driving the pile into the loose soil, thus ensuring total control during the driving of the piles and well beyond today's security standards.

Although it has been described using one or several preferred embodiments, it must be understood that the present invention can be used, employed and/or embodied in a multitude of other forms. Thus, the following claims must be interpreted so as to include these various forms while remaining outside the limitations set by the prior art.

The invention claimed is:

1. An apparatus for driving a pile into loose soil until reaching sufficiently hard soil to support the pile, said pile next being used to lift and stabilize a foundation of a building, the apparatus comprising:

a foundation board suitable for being fixed to the foundation and comprising a first pile guide suitable for receiving the pile in a vertical position;

a press head suitable for being installed at a given distance above the foundation board and comprising:

a second pile guide suitable for receiving the pile, the first and second pile guides being aligned so as to allow the pile to slide through the pile guides;

a rigid frame secured to the second pile guide and surrounding the second pile guide so as to slide along the pile; and two nonskid arms arranged in an opposite manner relative to the pile, each arm comprising a proximal end mounted at the rigid frame via a first pivot and a distal end projecting toward the pile and defining a nonskid surface once in contact with the pile;

a security system comprising a security lever connected to the rigid frame, the security system being configured to connect the distal end of each arm to the security lever, the security lever making it possible simultaneously to pivot the two arms between an open position where the nonskid surface of each arm is separated from the pile and a closed position where the nonskid surface is in contact with the pile such that the pile is retained by the two arms of the press head; and at least one extensible and retractable hydraulic jack connecting the foundation board to the rigid frame of the press head, each jack making it possible to apply a force on the press head and to drive the pile into the ground when the security system is activated and the nonskid arms are in the closed position.

2. The apparatus according to claim 1, comprising a pair of extensible and retractable hydraulic jacks connecting the foundation board to the rigid frame of the press head, the apparatus then defining a vertical plane of symmetry dividing the foundation board, the press head and the pair of hydraulic jacks longitudinally in two.

3. The apparatus according to claim 2, wherein each first pivot connects to the proximal end of the arm corresponding to a first termination of the corresponding hydraulic jack, a second termination of the jack being connected via a second pivot to the foundation board.

4. The apparatus according to claim 3, wherein the security lever comprises a third pivot connecting the lever to the rigid frame, a proximal end moving away from the third pivot along the plane of symmetry and forming a handle to actuate the lever, and a distal end adjacent to the third pivot.

5. The apparatus according to claim 4, wherein the security system further comprises:

for each arm, a horizontal bar with a length allowing one end of the bar to bear below the arm at its distal end, the other end of the bar forming a fourth pivot with a first end of a rod perpendicular to the bar, a second end of the rod belonging to the plane of symmetry and forming a fifth pivot with the second end of the rod of the opposite arm; and a connecting element belonging to the plane of symmetry and connecting the fourth pivot of the rods with the distal end of the lever such that when the lever is lowered, its distal end rises, driving, via the connecting element, the second ends of the rods upward, which, in turn, move the horizontal bars supporting the arms toward the plane of symmetry until the nonskid surfaces come into contact with the pile.

6. The apparatus according to claim 5, wherein the press head comprises a brace carried by the rigid frame above the lever between the pivot and the proximal end of the lever so as to be perpendicular to the lever, the brace making it possible to prevent the lever from moving upward.

7. The apparatus according to claim 5, wherein the connecting element is a spring.

8. The apparatus according to claim 5, wherein the distal end of each arm forms a stop for keeping the horizontal bar of the security system below the corresponding arm.

9. The apparatus according to claim 1, wherein the foundation board further comprises at least one vertical plate connected to the first pile guide and having a plurality of holes making it possible to bolt said at least one vertical plate to the foundation.

10. The apparatus according to claim 9, wherein the foundation board is L-shaped comprising a wing connected, perpendicular to a longitudinal direction of the first pile guide, to said at least one vertical plate so as to form a surface marrying a lower surface of the foundation.

11. The apparatus according to claim 9, wherein the foundation board further comprises at least one reinforcing ring to reinforce the first pile guide, each reinforcing ring having a section compatible with the section of the pile guide such that the pile guide is inserted into each reinforcing ring.

12. The apparatus according to claim 1, wherein the nonskid surface belongs to an interchangeable surface module driven into the distal end of the arm.

13. The apparatus according to claim 12, wherein the interchangeable surface module comprises a resilient polymer material forming the nonskid surface.

14. The apparatus according to claim 1, wherein the pile comprises a plurality of extender modules nesting in one another so as to extend the pile to reach soil that is hard enough to support the pile.

15. The apparatus according to claim 1, wherein the pile defines a square section, the first and second pile guides having a tubular shape with a square section marrying the square section of the pile.

16. The apparatus according to claim 15, wherein the pile ends with a pyramid-shaped module for penetrating the soil.

17. A method for driving a pile into loose soil until reaching sufficiently hard soil to support the pile, said pile next being used to lift and stabilize a foundation of a building, the method comprising the following steps:

i. fixing a foundation board comprising a first pile guide suitable for receiving the pile;

ii. procuring a press head suitable for being installed at a given distance above the foundation board and comprising:

a second pile guide suitable for receiving the pile, the first and second pile guides being aligned so as to allow the pile to slide through the pile guides;

a rigid frame secured to the second pile guide so as to slide along the pile;

two nonskid arms arranged in an opposite manner relative to the pile, each arm comprising a proximal end mounted at the rigid frame so as to pivot, and a distal end projecting toward the pile and defining a nonskid surface once in contact with the pile; and a security system comprising a security lever connected to the rigid frame, the security system being configured to connect the distal end of each arm to the security lever, the security lever making it possible to pivot each arm between an open position where the nonskid surface is separated from the pile and a closed position where the nonskid surface is in contact with the pile such that the pile is retained by the press head;

iii. connecting the foundation board to the rigid frame of the press head with at least one extensible and retractable hydraulic jack;

iv. sliding the pile in the second guide of the press head, then in the first guide of the foundation board until the pile reaches the loose soil;

v. if applicable, positioning each jack in a maximally extended position;

vi. actuating the lever of the security system such that the arms of the press head are in the closed position;

vii. simultaneously actuating each hydraulic jack so as to apply a force on the press head and thus driving the pile into the soil; and viii. if applicable, if the pile has not reached hard enough soil to support the pile: actuating the lever of the security system such that the arms of the press head are in the open position, the press head rising under the action of each jack to return to the maximally extended position; and ix. if applicable, repeating steps v) to viii) until the pile reaches hard enough soil to support the pile.

18. A method for lifting and stabilizing a foundation of a building, the method including steps i) to ix) of the method claimed in claim 17 for each of the piles necessary to lift and stabilize the foundation, and further comprising the following steps:

x. if applicable, removing the pair of jacks and the press head having served to install the piles;

xi. lifting the foundation and the building by exerting, simultaneously and in a controlled manner, on each pile, an inverse force on the corresponding foundation board until reaching a desired position for the foundation and the buildings; and xii. permanently welding each pile to the respective foundation board in order to stabilize the building.

19. The method according to claim 18, wherein step xi) consists of installing a hydraulic system suitable for bearing on each foundation board, the hydraulic systems being connected to one another so as to lift the foundation along the piles.

20. A kit for driving piles along a foundation, the kit comprising:

a press head as defined in claim 1 including the security system as defined in claim 1;

at least one foundation board as defined in claim 1;

at least one hydraulic jack suitable for connecting one of the foundation boards to the press head;

optionally, at least one pile or a plurality of pile modules nesting in one another to form a pile; and optionally, a user manual for the kit.

* * * * *